US005327046A

United States Patent [19]

Ravi et al.

[11] Patent Number: 5,327,046

[45] Date of Patent: Jul. 5, 1994

[54] HIGH PRESSURE DISCHARGE LAMP HAVING OVERCURRENT FUSE PROTECTION

[75] Inventors: Jagannathan Ravi, Elmira, N.Y.; Gerard Luijks, Gerwen, Netherlands

[73] Assignee: North American Philips Corporation, New York, N.Y.

[21] Appl. No.: 966,214

[22] Filed: Oct. 26, 1992

Related U.S. Application Data

[63] Continuation-in-part of Ser. No. 626,914, Dec. 12, 1990, Pat. No. 5,159,242.

[51] Int. Cl.[5] ..... H01J 7/44

[52] U.S. Cl. ..... 315/52; 315/71; 315/72; 315/73

[58] Field of Search ..... 315/50, 73, 74, 71; 337/22, 23, 24, 27, 159; 338/308, 309

[56] References Cited

U.S. PATENT DOCUMENTS

| | | | |
|---|---|---|---|
| 3,353,136 | 11/1967 | Umantsev . | |
| 3,947,799 | 3/1976 | Epaneshnikova et al. . | |
| 3,978,443 | 8/1976 | Dennis et al. | 338/309 |
| 4,258,288 | 3/1981 | Michael et al. | 315/60 |
| 4,755,721 | 7/1988 | Okada et al. . | |
| 4,792,782 | 12/1988 | Hammond . | |
| 4,901,051 | 2/1990 | Murata et al. . | |
| 5,008,583 | 4/1991 | Carleton | 313/25 |
| 5,015,916 | 5/1991 | Mazza et al. . | |
| 5,159,242 | 10/1992 | Ravi | 315/52 |

FOREIGN PATENT DOCUMENTS

| | | |
|---|---|---|
| 0160311 | 5/1985 | European Pat. Off. . |
| 56-73856 | 6/1981 | Japan . |
| 58-82453 | 5/1983 | Japan . |
| 58-155642 | 9/1983 | Japan . |
| 1211896 | 8/1989 | Japan . |

OTHER PUBLICATIONS

U.S. patent application Ser. No. 07/966,245.

*Primary Examiner*—James B. Mullins
*Assistant Examiner*—J. Dudek
*Attorney, Agent, or Firm*—Brian J. Wieghaus

[57] ABSTRACT

A high intensity discharge (HID) lamp includes a resistive fuse for overcurrent protection of its associated ballast, which fuse is connected electrically in series with the discharge vessel of the lamp and continuously dissipates power during lamp operation. The resistive fuse is heated by passage of the operating current through the discharge vessel during lamp operation to a temperature substantially controlled by the operating current. In response to an increase in the operating current to a predetermined overcurrent, the resistive fuse reaches a temperature such that it breaks and disconnects the discharge vessel from its source of electric potential within a predetermined time period. The fuse passes short-term high starting currents and does not disconnect the discharge vessel during each lamp start-up at least until the operating current reaches the predetermined over-current during lamp life.

14 Claims, 3 Drawing Sheets

HIGH PRESSURE DISCHARGE LAMP HAVING OVERCURRENT FUSE PROTECTION

CROSS-REFERENCE TO RELATED APPLICATIONS

This is a continuation-in-part of U.S. application Ser. No. 626,914 filed on Dec. 12, 1990, now U.S. Pat. No. 5,159,242 entitled "High Pressure Discharge Lamp Having An Integral Thick Film Resistor With Multiple Resistive Elements" of Jagannathan Ravi which discloses and claims an HPS discharge lamp having an integral thick-film resistor comprising a plurality of resistive elements.

Also of interest is U.S. application Ser. No. 07/966,245, filed concurrently herewith, of J. Ravi, Geert Van Bockstaal, Go Suzuki and Konji Shirasu which discloses and claims an improved integral thick film resistor for discharge lamp applications.

BACKGROUND OF THE INVENTION

1. Field of the Invention

The invention relates to high pressure gas discharge lamps, and more specifically, to a fuse for such lamps.

2. Description of the Prior Art

High intensity discharge (HID) lamps include a discharge vessel typically arranged within an outer envelope. The discharge vessel includes a discharge sustaining filling, a pair of discharge electrodes between which a gas discharge takes place during lamp operation, and conductive lead-throughs extending from each electrode through a wall of the discharge vessel to the exterior in a gas-tight manner. For high pressure sodium (HPS) lamps the discharge vessel is typically of a ceramic material such as a polycrystalline alumina whereas for mercury vapor and metal halide lamps the discharge vessel is typically of fused silica (quartz glass).

All HID lamps are operated on a current limiting ballast because of the negative resistance characteristics of the gas discharge in the discharge vessel. In certain combinations of HID lamps and ballasts, a condition may occur in which the operating voltage of the discharge vessel, as measured across its lead-throughs, is reduced and the current through the ballast and lamp is increased. Such a condition may occur, for example, in unsaturated HPS lamps due to sodium loss or in any HPS lamp which develops an arc tube leak.

A well known problem in HPS lamps is the progressive loss of sodium over rated lamp life (approximately 24,000 hours) due to reaction and/or absorption of sodium with the ceramic discharge vessel, the sealing frit sealing the end of discharge vessel, and the emitter material on the electrode.

As compared to saturated HPS lamps, unsaturated lamps have a very small quantity of sodium and mercury selected such that the sodium and mercury are completely vaporized during lamp operation. Any loss of sodium reduces the lamp voltage. Despite great emphasis to eliminate this so-called "sodium clean-up", unsaturated HPS lamps are still subject to the progressive loss of sodium, which causes a gradual decrease in the operating voltage ("voltage slump") of the discharge vessel over rated lamp life.

For a typical unsaturated HPS lamp having an initial operating voltage of about 130 volts, the voltage slump over life is on the order of 25–30 volts. When used with most ballasts, the electric current through the discharge vessel increases as its operating voltage decreases. When the operating voltage slumps enough, there is danger of damage to the ballast, for example over a period of several hundreds of hours, because of the increased current ("over-current") through the lamp and ballast.

It would be desirable to provide a fuse within the lamp outer envelope to disconnect the discharge vessel from the ballast at some predetermined over-current. However, no commercially available HID lamps are provided with such protection. Ballast damage can occur when the over-current has increased to only between about 15 and 30 percent above the nominal lamp current. Typical fuses, such as those which employ a metallic foil that melts apart under excess current, cannot function to reliably disconnect the arc tube with such an over-current. Additionally, HID lamps typically have a current at lamp ignition which is 2 to 3 times the rated lamp current. The current decreases to the normal operating value only after a warm-up period of several minutes. This condition exists because of the time taken for the arc tube voltage to build up. Any fuse in series with the arc tube would need to discriminate between the high current condition during ignition and warm-up (hereinafter referred to as "start-up") and the prolonged high current during lamp operation due to the lamp voltage slump.

The high ambient temperature of about 250° C. due to heat from the discharge vessel and the possibility of a vacuum environment within the outer bulb are other factors to consider for a fuse that is to be placed within the lamp. Commercially available fuses are generally rated for ambient temperature, their fusing capabilities being substantially reduced for higher temperatures. Commercially available fuses for operation at 250° C. do not appear to be available. Furthermore, the typical design requirement for a fuse that it has near zero resistance during normal operation makes it very difficult to design a fuse for this lamp application.

Mounting of the fuse element is also an important consideration, both from the manufacturing and cost point of view, and also because of the effect other lamp components may have on the operation of the fuse. In addition to the discharge vessel and a support frame which supports the discharge vessel, many HID lamps already contain multiple elements within the outer envelope such as, for example, the components of a starting circuit.

In metal halide lamps and mercury vapor lamps, the starting circuit typically includes an auxiliary electrode in the discharge vessel adjacent one of the discharge electrodes, which auxiliary electrode is connected with the opposite discharge electrode through a current limiting resistor. Often a bimetal switch is in series with the current limiting resistor to remove the resistor and the auxiliary electrode after starting and stabilization of the discharge arc. A common starting circuit for HPS lamps includes a glow starter switch in series with a current limiting resistor and a bimetal, all of which are in parallel circuit with the arc tube. Resistors used in this type of HPS starting circuit typically have a resistance of over a hundred ohms and dissipate high power, on the order of several hundred watts. They are electrically disconnected from the arc tube circuit by the glow switch shortly after ignition of the discharge arc, typically within approximately 20 seconds after initial application of an electric potential to the lamp. Thus, heat from the starting resistors in addition to that from the discharge vessel must also be considered when selecting and mounting a fuse in these lamps.

Thick film resistors are suitable for starting circuits because they reliably dissipate the required several hundred watts for the period just prior to lamp starting (≈20 sec) while having a long life. These are known, for example, from U.S. application Ser. No. 07/378,879 filed Jul. 12, 1989 shows a thick film resistor in a starting circuit for high pressure sodium discharge lamps. J.P. Kokai 56-73856 discloses a thick film resistor as a starting resistor for metal halide lamps and high pressure sodium discharge lamps.

Additional resistors may be electrically connected to the discharge vessel during lamp operation to improve lamp performance. For example, U.S. Pat. No. 4,258,288 (Michael et al) discloses a metal halide lamp for connection to a constant wattage (CWA) ballast of the type having a transformer with a secondary winding in series with a capacitor. The lamp has an internal voltage-doubler starting circuit with two resistors in series with a bimetal switch. The bimetal switch disconnects the starting circuit and auxiliary electrode after starting of the lamp. The lamp also has a third power resistor in series with the discharge vessel which reduces the phase shift between the lamp voltage and the ballast open circuit voltage during lamp warm-up. The resistor increases the maximum sustaining voltage to the lamp when the lamp current is zero, thereby preventing flicker and extinguishment of the arc.

Japanese Kokai 1-211896 shows an unsaturated HPS lamp suitable for operation on a CWA ballast. The lamp has a resistor in series with the discharge vessel to reduce the reignition voltage of the discharge voltage to prevent flicker of the arc, which otherwise occurs under certain operating conditions of the ballast and lamp. Because the resistor is in series with the discharge vessel, it operates continuously during lamp operation after ignition of the discharge arc and dissipates considerable power, approximately 15 watts for a 150 watt lamp.

SUMMARY OF THE INVENTION

It is an object of the invention to provide an HID lamp having a fuse which can reliably operate in the high temperature environment within the lamp outer envelope.

Another object of the invention is to provide a fuse which can reliably distinguish between a short term high current during lamp start-up and a long term increase in lamp operating current due to voltage slump from sodium loss or a leaky discharge vessel.

Still another object of the invention is to provide such a fuse without increasing the number of lamp parts in HID lamps already having multiple resistor components for lamp starting and/or improving lamp performance.

According to the invention, an HID lamp includes a power dissipating resistive fuse connected electrically in series with the discharge vessel for disconnecting the discharge vessel from its source of electric potential upon an increase of the operating current through the discharge vessel to a predetermined over-current during lamp life. The resistive fuse is heated by passage of the operating current during lamp operation to a temperature substantially controlled by the operating current. The resistive fuse is selected such that in response to an increase in the operating current to the predetermined over-current, the resistive fuse reaches a temperature such that it cracks and disconnects the discharge vessel from its source of electric potential within a predetermined time period and such that it passes the short-term high current during start-up and does not disconnect the discharge vessel during each start-up. As used herein, "power dissipating" means a resistive fuse element which continuously dissipates about 1 watt or greater during lamp operation.

The invention is based on the recognition that if a resistor is heated to a high temperature by the current through discharge vessel during normal lamp operation, it can be designed to fail with an over-current which is a smaller percentage of the nominal operating current than a fuse component, such as a metal foil having a low resistance, which is not normally heated to a high temperature during normal lamp operation.

According to one embodiment, the fuse is comprised of a metallic resistive element connected to a substrate. In response to the long term increase in lamp current, the substrate reaches a temperature such that it cracks, breaking the metallic resistive element, and disconnecting the discharge vessel from the source of electric potential while passing the short-term high starting current as discussed above. In a favorable embodiment, the fuse is comprised by a thick film ceramic resistor having a ceramic substrate and a thick film tungsten resistive element deposited on said substrate. It has been found that such a fuse can be designed to fail within about 100 hours once an overcurrent as low as about 25 percent of the nominal operating current has been reached over lamp life, which is sufficient to protect a ballast from damage.

The use of continuously power dissipating resistors as fuses in HID lamps has not been evident. While thick film resistors have been used in HID lamps, they have not been used as fuses. Except as disclosed in the above-mentioned U.S. parent application Ser. No. 626,914 (now U.S. Pat. No. 5,159,242), they have also not been used as continuous duty resistors for power applications. Even where a thick film resistor has been employed in a starting circuit for very high power dissipation prior to starting, separate resistors have been used for lower power continuous duty applications. For example, the above-mentioned J.P. 56-73856 shows a conventional carbon resistor in series with the auxiliary electrode in addition to the thick film short-duty starting resistor.

In a lamp already having a series connected resistor for improving lamp performance, such as for preventing flicker in an unsaturated HPS lamps for mercury retrofit, it is advantageous if this resistor also functions as the fuse as discussed above. The fusing action would be required in the event of an arc tube leak. Preferably, a thick film resistor comprises all of the resistor/fuse means present in such a lamp so that only one resistor component, the integral thick film resistor/fuse, needs to be mounted within the lamp envelope. The power density of the integral resistor is selected such that the substrate cracks within a time period such that damage to a typical ballast is avoided when the operating current through the discharge vessel and second resistive element reaches a predetermined over-current.

This construction has the advantage that the number of resistor components which must be mounted in the lamp is less than the number of resistor means required in the lamp. In addition to simplifying the mount structure and increasing the ruggedness of the lamp, the use of one resistor/fuse component reduces the number of parts which must be handled during lamp assembly, reducing loss and breakage, and consequently lamp cost.

The resistor/fuse means included in the integral thick film resistor are comprised of corresponding metallic resistive elements, such as conventional metallic deposition patterns, all of which may be disposed on a single substrate. However, in a particularly advantageous embodiment, the thick film resistor comprises a plurality of integral substrate layers with the metallic resistive elements disposed between corresponding layers. This has the advantage that the length and width dimensions of the substrate may be minimized to the dimensions required by the metallic deposition pattern of the resistive element with the highest ohmic value. For example, the pattern for a resistive element may be disposed on a first substrate layer and the patterns for one or more elements of substantially less resistance may be arranged on a second substrate layer, or on the reverse side of the same substrate within the dimensions of the larger resistive pattern. Alternatively, each pattern may be disposed on a respective substrate layer.

Additional advantages and features such as preheating of a continuous duty series-connected resistive element by a high power short-duty resistive element of a starting circuit and the provision of a second bimetal switch to disconnect the starting resistive element in response to heat from the discharge vessel or resistor, are fully described in the above-mentioned U.S. Pat. No. 5,159,242 and are herein incorporated by reference.

Other objects, features and advantages of the invention will become apparent from the following description and appended claims when considered in conjunction with the accompanying drawings.

DESCRIPTION OF THE PREFERRED EMBODIMENT

Figure 1A:
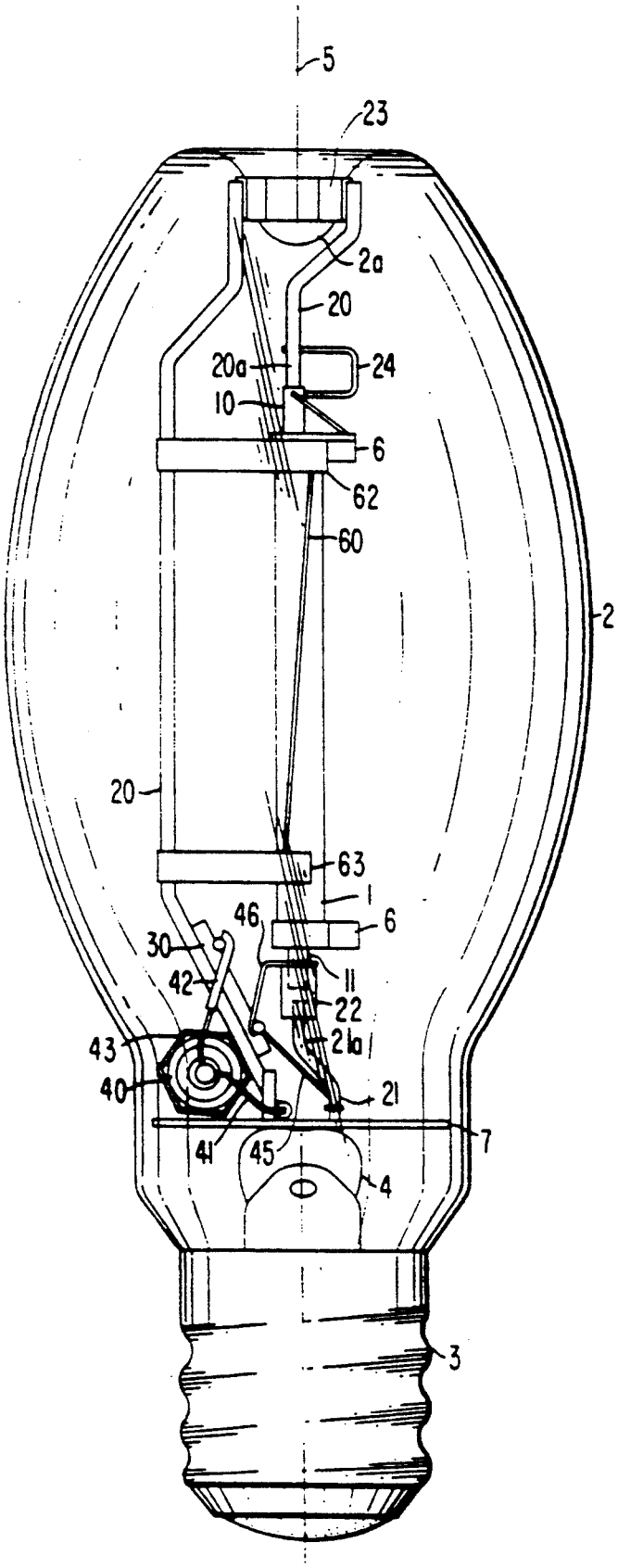
FIG. 1A illustrates a high pressure sodium vapor discharge lamp according to the invention having a fuse in the form of a thick film resistor.

The lamp shown in FIG. 1A is a high pressure sodium (HPS) discharge lamp comprised of an elongate discharge vessel 1 of the unsaturated type disposed within an outer envelope 2 and having a lamp base 3 at one end of the outer envelope 2. The envelope is evacuated, and sealed in a conventional manner by stem 4. The discharge vessel has a pair of conductive feedthroughs 10, 11 for applying a voltage to a pair of discharge electrodes within the discharge vessel. Conventional metallic heat shields 6 surround the discharge electrodes adjacent the ends of the discharge vessel 1.

A quantity of sodium-mercury amalgam is contained within the discharge vessel 1, together with an inert buffer gas such as xenon. The discharge vessel is supported within the lamp envelope by conductive support rods 20 and 21 and insulative glass support element 22. The glass support 22 has opposing bores for receiving the end 21*a* of support rod 21 and feed-through 11, to support the arc tube and electrically insulate the feedthrough 11 from conductive support 21.

After ignition of the discharge vessel, for example by an external ignitor, the lamp current through the discharge vessel has a short-term peak which is about two (2) to three (3) times that of the lamp current during steady-state lamp operation. This high-current state lasts for a short-term of several minutes from ignition of the discharge until the lamp warms-up to its steady state operating temperature. This occurs each time the lamp is started.

The unsaturated discharge vessel 1 is of the improved color type and has a high sodium pressure of greater than about 3 times that of a standard HPS lamp. Over lamp life, the gradual loss of sodium from the discharge device causes the lamp voltage to decrease, or slump, on the order of greater than 30 volts. This leads to a corresponding increase in lamp current above the nominal rated current of greater than 25%. This overcurrent is reached after the lamp has stabilized after starting.

A ceramic thick-film resistor/fuse 30 is secured between the conductive support rods adjacent the stem and has a resistive element connected electrically in series with the discharge vessel 1. For illustrative purposes, reference is made to FIG. 2 which shows a resistor/fuse according to another embodiment of the invention. The resistor 30 for the lamp of FIG. 1A includes only the substrates 31*a* and 31*c*, the resistive element 33, and the two terminals 34*a*, 34*b*. The resistive element 33 is connected in series with discharge vessel via lead 45 (FIG. 1A) connected to current conductor 21 and terminal 34*b* and lead 46 connecting lead 34*a* to lead-through 11. The resistive element 33 is a conventional thick film tungsten deposition pattern. The substrate consists of "white" alumina (composition by weight: $Al_2O_3$—91%, $SiO_2$—5%; MgO—2%; CaO—1%; other—1%).

The lamp also has a starting aid for inducing ionization throughout the discharge vessel within the limits of the high voltage pulse of the starting circuit. The starting aid consists of conventional antenna 60 and bimetal elements 62 and 63 which are welded to the support rod 20. In the inoperative condition of the lamp, the bimetal elements 62, 63 hold the starting antenna against the wall of the discharge vessel.

According to the invention, the resistor is effective as a fuse for disconnecting the discharge vessel from its source of electric potential, as supplied through conductors 20, 21, when the lamp operating current increases to greater than about 25% of its nominal value. When the lamp is operated for an extended period of time at such an increased current level, damage to the ballast may result due to overheating. Applicants discovered that if the dimensions of the ceramic substrate and its power densities are appropriately selected, the resistor substrate will crack within a predetermined time period in response to the long term increase in lamp current. The cracked substrate severs the tungsten deposition pattern of the series-connected resistive element 33, disconnecting the discharge vessel from the current-supply conductors and the ballast. The fuse, however, will reliably pass the high starting current experienced during lamp startup, at least until the preselected overcurrent is reached during lamp life.

Since the resistive element 33 is in series with the discharge vessel, it continuously dissipates power during lamp operation. The resistance of this element can be selected such that the temperature of the substrate is determined substantially by the heat dissipated by this element, rather than by heat radiated from the discharge vessel. Thus, its temperature is substantially independent of placement within the lamp. Furthermore, since the resistor is already heated to a high temperature, it can be designed to fail with an over-current which is a much smaller percentage of the nominal operating current than conventional metallic foil fuses of low resistance. While the fuse dissipates power during lamp operation, it can be kept by design to a very low value, for example less than about 3 watts.

Figure 3:
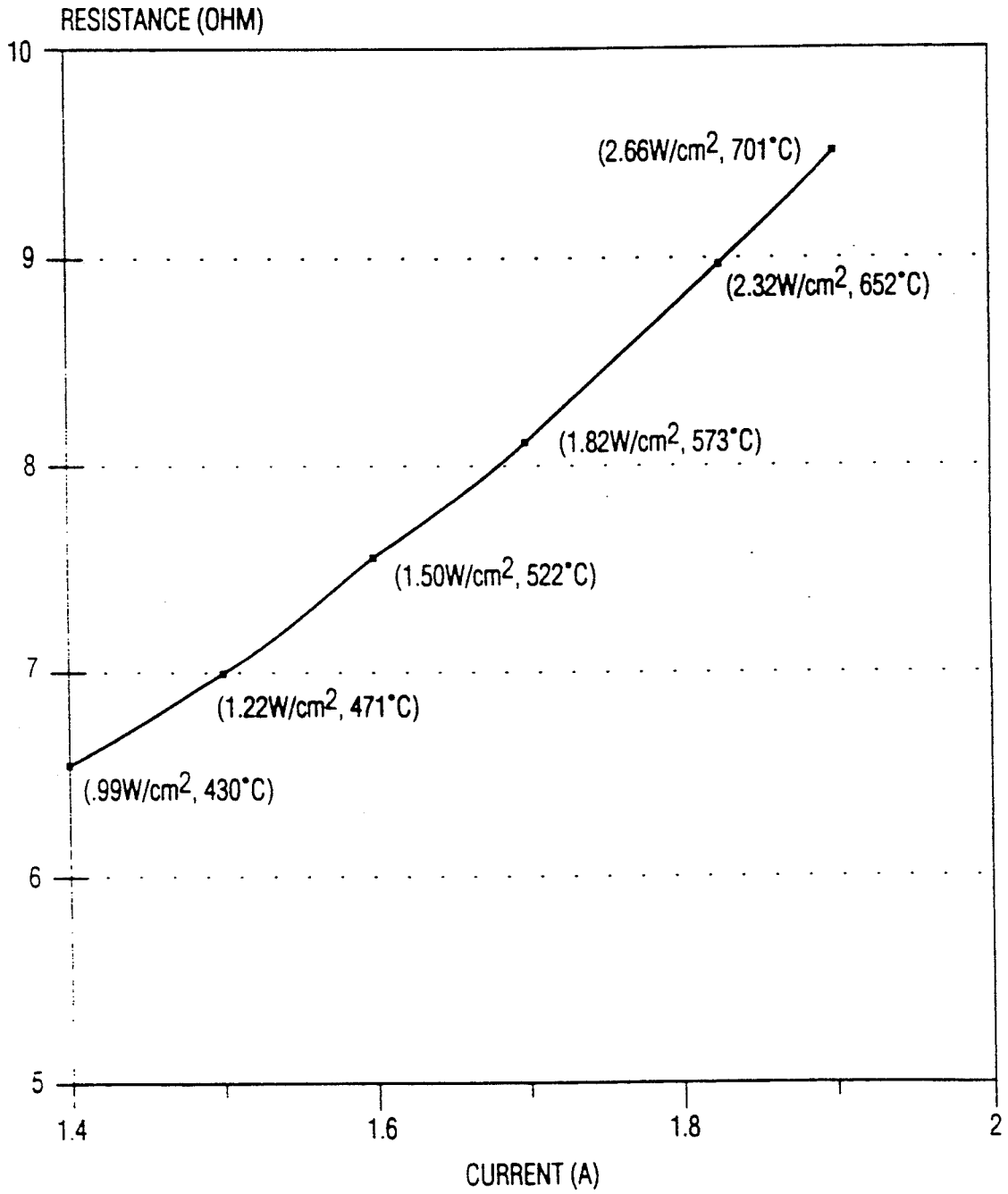
FIG. 3 shows a graph of current vs. resistance for a resistor/fuse according to the invention.

To test the feasibility of a resistor/fuse which can reliably fuse out at an overcurrent of 25% above nominal, a thick film resistor having the following characteristics was tested in a 150 watt unsaturated HPS Philips RETROLUX TM lamp. FIG. 3 shows the surface power dissipation and temperature characteristics for this resistor at different current levels. The lamp has a nominal lamp current of 1.5 A and the resistor was selected to fuse at a fusing current of 1.9 A, which is about 25% greater than the nominal. Based on this experience, a thick film resistor fuse can be designed for low power dissipation as follows:

FUSE RESISTOR EXAMPLE

Let fuse resistance, $R_f = 1\ \Omega$ (at $I = 1.5$ A)
Then, $P_f = I^2R = 2.25$ W
substrate operating temperature at 1.5 A $T = 471°$ C. (744K)
tungsten track cross-section dimensions $\cong 4\ \mu m \times 0.8$ mm
tungsten track cross-sectional area $A = 3.259 \times 10^{-5}$ sq.cm
power density $P_d = 1.22$ cm$^2$
tungsten resistivity $\rho$ ($T = 744$ K$^d$) $= 16.97\ \mu\Omega$-cm
track aspect ratio $L/A = R_F/\rho = 0.0589 \times 10^6$/cm
track length $= 1.92$ cm
surface area of alumina substrate $= P/P_d = 1.844$ sq. cm $$R_{cold} \times \rho\ (T = 27°\ C) \times L/A \cong 5.0\ \mu\Omega\text{-}cm \times 0.0589 \times 10^6/cm = 0.295\Omega$$

At the fusing current level of 1.9 A, the resistor can be expected to attain a temperature of 701° C. (974K), based on the design and performance of the resistor whose characteristics are shown in FIG. 3. Hence, $$i\ R(T = 974K) = \rho(974K) \times L/A = 23.689\ \mu\Omega\text{-}cm \times 0.589 \times 10^6/cm = 1.395\Omega$$

The power dissipated in the at 1.9 A fuse is $P(T = 974K) = 5.04$.

W and the power density is $P_d = 2.73$ W/cm$^2$.

At this power density, the resistor was found to reliably crack in <100 hours at a current of 1.9 A. This is sufficient to prevent damage to a typical ballast. Thus, by careful choice of design, the desired time to fuse out at a particular overcurrent level may be attained without degradation at the nominal current. Once the particular overcurrent level is reached over lamp life, the resistor fuse will crack after the lamp has stabilized. This fuse would also be effective in the rare event of a leaky arc tube, in which the overcurrent would be much greater than 25%.

The 'white alumina' substrate has an emissivity of about 0.5. For this substrate, it has been found that at operating temperatures of below about 500° C., the resistor/fuse will not crack over lamp life. At operating temperatures of above about 700° C., the substrate will crack in a time period dependent on the temperature. The fusing time can be modified, for example, by changing the size and shape of the resistor. Another approach is to change the emissivity of the resistor. If employed in an evacuated outer envelope, the principle form of heat transfer is by radiation. By lowering the emissivity of the substrate, the temperature will be higher and shorten the fusing time. The emissivity may be lowered with a metallic coating of nickel or aluminum, for example, deposited on the outer surface of the resistor/fuse.

Figure 1B:
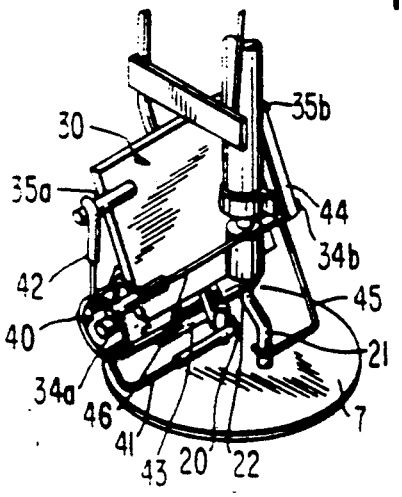
FIG. 1B illustrates a mounting arrangement for another HPS lamp having an integral thick film resistor/fuse which includes a first resistive element as a starting resistor and a second resistor for flicker elimination.

FIG. 1B shows a mount construction for a lamp according to another embodiment. In this embodiment, the lamp is an unsaturated lamp for mercury retro fit for operation an a CWA ballast. The fill of the discharge vessel is such that over lamp life the voltage slump will not be large enough to cause damage to a CWA ballast. However, in the rare event of a leaky arc tube, fusing action is desired. The lamp includes a starting circuit with a first resistive element and a second resistive element for flicker elimination, both resistive elements being embodied in the combination resistor 30.

As previously mentioned, the thick film resistor has 3 ceramic substrate layers 31*a*, 31*b*, and 31*c*. As shown schematically in FIG. 2, a first resistive element 32 consisting of a conventional deposited tungsten thick film pattern is disposed on the substrate layer 31*b* and a second series connected resistive element 33 also of a conventional tungsten thick film is disposed on substrate layer 31*c*. The first substrate layer 31*a* protects the first resistive element. Resistor terminals 34*a*, 34*b* on substrate 31*a* are connected to the second resistive element 33 and terminals 35*a*, 35*b* are connected to the first resistive element 32. The metallic deposition patterns themselves are conventional and the number of patterns for any given resistance value which may be needed in an HID lamp are numerous.

A starting circuit for starting the discharge vessel consists of a conventional glow starter switch 40, having a pair of bimetallic electrodes therein, in series with the first resistive element 32 and a bimetal switch 44 welded to terminal 34*b* and normally closed against terminal 35*b*. (FIG. 1*b*) The glow starter 40 is supported by a glow starter holder 43 welded to the conductive support 20. The starting circuit defines a first conductive path in parallel with the discharge vessel 1. The starting circuit consists of a first lead 41 of the glow starter connected to the conductive support rod 20, the glow starter, a second glow starter lead 42 connected to resistor terminal 35*a*, the first resistive element 32, the resistor terminal 35*b*, bimetal switch 44, terminal 34*b*, and support-lead 45 connected to conductive support 21.

A second conductive path extends from the conductive support rod 21, through support-lead 45 to terminal 34*b* of the second resistive element, through the second resistive element 33, the other terminal 34*a*, lead 46, and through niobium feed through 11 through the discharge vessel 1, through niobium feed through 10, connector 24 and conductive rod 20. The lamp has a starting and as discussed with respect to the first embodiment.

For a complete description of the functioning of the starting aid and the starting circuit during ignition and warm-up of the lamp, reference is made to the above-mentioned U.S. application Ser. No. 626,914, filed Dec. 12, 1990 (now U.S. Pat. No. 5,159,242), herein incorporated by reference.

In the rare event that an HPS lamp has a cracked or leaky arc tube, the voltage slump may be on the order of 50 volts, which causes a lamp current increase from nominal of much greater than 25%. Thus, over lamp life, each time the lamp has been ignited and warmed-up, it may assume a steady state operating current of much greater than 25% of the nominal designed current if the discharge vessel has a leak.

As discussed above, the voltage slump of this lamp is not enough to cause ballast damage. However, a certain margin in the power dissipation capability of the resistor is required in order to accommodate a higher lamp current either due to an increase in the supply voltage and/or the slump in lamp voltage that this HPS lamp will experience due to sodium loss over lamp life. Taking the above into consideration, it has been determined that the resistor/fuse for this application should be capable of operating at an upper current level of 1.9 A without fusing action, i.e., cracking of the substrate, even though the nominal lamp current is only 1.5 A. At 1.9 A, the resistor power dissipation is about 28 W, i.e., nearly double the dissipation at the lower, nominal current level if the resistive element 33 has a value of about 2.1 ohms. This overload condition imposes stringent requirements on resistor construction to avoid fusing in the range 1.5 A to 1.9 A while obtaining fusing at the higher currents encountered with leaky arc tubes.

Fusing action can be avoided by reducing the resistor temperature sufficiently over the expected current range of 1.4 A to 1.9 A. The resistor temperature may be lowered by having a lower cold resistance and/or by increasing the surface area and/or surface emissivity (since radiation is substantially the only form of heat dissipation). The conventional "white" alumina surface for the first embodiment is estimated to have an emissivity of about 0.5 for the resistor operating conditions. When resistors (from the same batch) were coated with graphite (emissivity $>0.9$), a substantial drop in the resistance was observed, confirming that radiation is indeed the dominant mechanism for heat dissipation in an evacuated outer envelope. There is a temperature difference of over about 100° C. between the coated and uncoated resistors at a current of 1.9 A.

While coating of the resistor surface with graphite has been shown to be effective in reducing the resistor temperature and ohmic value, it is not the most advantageous for manufacturing. A preferable method is to alter the resistor substrate composition to achieve a high emissivity. This is obtained with "black" alumina having a composition by weight of ($Al_2O_3$—91%; $SiO_2$—5%; MgO—2%; CaO—1% $TiO_2$—1%; others 1%). Though dark purple in color, it is usually referred to as "black" alumina.

For the lamp current range of interest, the "black" alumina resistor is very close in performance to those of the graphite coated resistors, indicating that its surface emissivity approaches that of the latter and that it is a feasible approach to reduce resistor temperature.

The reduction in temperature due to higher surface emissivity eliminated resistor failures due to substrate cracking at 1.9 A operation. Both the graphite coated resistors and the "black" alumina resistors were operated at 1.9 A in vacuum up to 3000 hours without any failures. By contrast, the resistors with "white" alumina substrates failed by cracking in less than 100 hours.

In order to provide a further margin of safety, the cold resistance was reduced to 1.9 Ω, nominal. With these improvements, spreads in lamp operating conditions and resistor tolerances can be handled without fusing by resistor failure at the highest expected lamp current of 1.9 A out to an HPS lamp life of about 24,000 hours.

Figure 2:
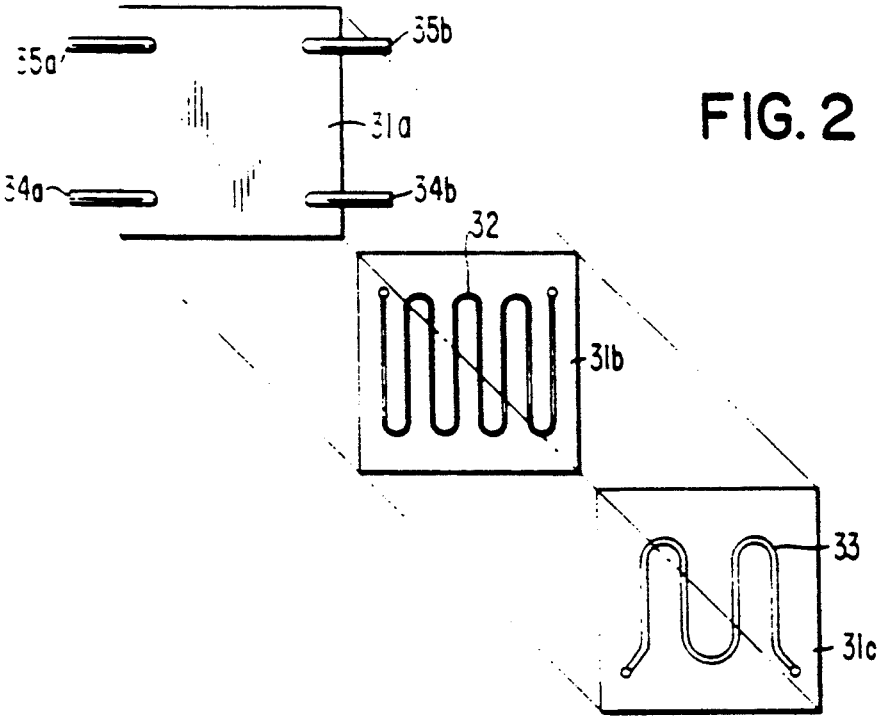
FIG. 2 shows an exploded view of a thick film resistor/fuse with a plurality of substrates and resistive elements.

The design of a practical integral resistor as shown in FIG. 2 embodying these concepts is summarized below. The resistor consists of two thick-film resistor elements, a high valued (165 ohm) starting element for short duty and a low valued (1.9 ohm) resistor for continuous operation. High emissivity "black" alumina substrates were employed. While not failing at 1.9 A (25% above the nominal current), this resistor will fail at the much higher currents associated with a leaky arc tube.

In the lamp having the combination resistor of FIG. 1*b*, the value of the first resistive element is 165 ohms at 23° C. and dissipates approximately 200 watts during operation of the starting circuit. If the discharge arc is successfully ignited, the first resistive element is operative for only approximately 15 to 20 seconds after initial application of the electric potential to the lamp. The value of the second resistive element after the resistor substrate has reached a steady operating temperature of approximately 425° C. is 6–8 ohms. The second resistive element dissipates approximately 15 watts and is effective for reducing the reignition arc voltage of the arc tube to prevent flicker, under certain conditions, of the discharge arc when the lamp is operated on a CWA ballast.

The integral combination resistor has width and height dimensions which are no larger than the dimensions of a similar thick film resistor having only a 165Ω resistive element for a starting circuit. The incorporation of a series flicker elimination resistor/fuse into the same sized component effectively eliminates the mounting of an additional resistor component for the series flicker elimination element and an additional fuse component and facilitates a simpler mount construction.

In addition to the mounting and reliability advantage of providing the integral ceramic resistor in the lamp shown in FIG. 1, the provision of the high power dissipating starting resistive element 32 on an integral substrate with the lower power dissipating flicker elimination/fuse resistive element 33 has the advantage that during starting the heat from the first resistive element heats the substrate so that the resistance of the lower resistive element 33 increases more quickly to its desired operating value. This has the operational advantage that the reignition voltage of the discharge vessel was reduced, and flicker prevented more quickly than with a separate resistor component.

The combination of the lower wattage flicker elimination resistor with the high wattage starting resistor on an integral substrate also has the advantage that the lower wattage resistor element 33 is substantially preheated by the first resistive element prior to flow of the lamp current, and is thus subject to reduced thermal shock.

While there has been shown to be what are presently considered to be the preferred embodiments of the invention, it will be apparent to those of ordinary skill in the art that modifications can be made to the lamps without departing from the scope of the invention as defined by the appended claims. For example, resistors having substrates other than ceramic alumina and other than the planar shape shown in FIGS. 1–3 would be feasible.

We claim:

1. In a high pressure discharge lamp having a discharge vessel, and means for connecting said discharge vessel to a source of electric potential to energize said discharge vessel to emit light, said discharge vessel having an operating current during lamp operation and a short-term starting current substantially greater than said operating current during lamp start-up, said operating current of said discharge vessel increasing over lamp life from a nominal operating current to an overcurrent higher than said nominal operating current, the improvement comprising:

a power dissipating resistive fuse connected electrically in series with said discharge vessel for disconnecting said discharge vessel from said source of electric potential upon an increase of said operating current to a predetermined overcurrent over lamp life, said resistive fuse being heated by passage of said operating current during lamp operation to a temperature substantially controlled by said operating current, said resistive fuse being selected such that in response to an increase in said operating current to said predetermined overcurrent, said resistive fuse reaches a temperature such that it breaks and disconnects said discharge vessel from said source of electric potential, said resistive fuse passing said short-term starting current and not disconnecting said discharge vessel during each lamp start-up.

2. In a lamp according to claim 1, wherein:

said resistive fuse comprises a substrate and a metallic resistive element disposed on said substrate, said metallic resistive element heats said substrate to a temperature during lamp operation substantially controlled by said metallic resistive element and positively dependent on said lamp operating current, and said substrate is selected such that in response to said operating current increasing to said predetermined overcurrent, said substrate reaches a temperature such that said substrate cracks, breaking said metallic resistive element and disconnecting said discharge vessel from said source of electric potential.

3. In a lamp according to claim 2, wherein said resistive fuse is comprised of a thick film ceramic resistor having a ceramic substrate and a thick film tungsten resistive element deposited on said substrate.

4. In a lamp according to claim 3, wherein said lamp is a high pressure sodium discharge lamp, and said resistive element comprising said fuse is effective for preventing flicker of light emitted from said discharge vessel when said lamp is operated on a constant-wattage-type ballast.

5. In a lamp according to claim 4, wherein said lamp further comprises a starting circuit for igniting said discharge vessel, said starting circuit including a starting resistor; and an integral thick film resistor comprises said resistive fuse and said starting resistor.

6. In a lamp according to claim 3, wherein said lamp further comprises a starting circuit for igniting said discharge vessel, said starting circuit including a starting resistor; and an integral thick film resistor comprises said resistive fuse and said starting resistor.

7. In a lamp according to claim 2, wherein said lamp further comprises a starting circuit for igniting said discharge vessel, said starting circuit including a starting resistor; and an integral thick film resistor comprises said resistive fuse and said starting resistor.

8. In a lamp according to claim 3, wherein said resistive fuse comprises a coating on said substrate having an emissivity lower than the emissivity of said substrate for decreasing the heat transfer therefrom.

9. In a lamp according to claim 2, wherein said lamp further comprises a starting circuit for igniting said discharge vessel, said starting circuit including a starting resistor; and an integral thick film resistor comprises said fuse means and said starting resistor.

10. A high pressure sodium discharge lamp, comprising:

(a) an outer envelope, (b) a discharge vessel disposed within said outer envelope and energizable for maintaining a discharge during lamp operation, said discharge vessel containing a discharge sustaining filling comprising sodium and mercury, (c) means for connecting said discharge vessel to a source of electric potential, said discharge vessel having an operating current during lamp operation and a short-term high current substantially higher than said operating current during lamp start-up, said operating current of said discharge vessel increasing over lamp life from a nominal operating current to an overcurrent higher than said nominal operating current, (d) starting means connected to said discharge vessel for generating a voltage sufficient for inducing ionization through said discharge vessel, and (e) an integral thick film resistor disposed within said outer envelope, said integral resistor comprising a ceramic substrate and first and second thick film metallic resistive elements deposited on said substrate, said second resistive element being connected electrically in series with said discharge vessel, said operating current flowing through said second resistive element and heating said substrate during lamp operation, said substrate having a temperature during lamp operation substantially controlled by said second resistive element and positively dependent on said lamp current, and said substrate and second resistive element being selected such that in response to said long term increase in lamp current, said substrate reaches a temperature such that said substrate cracks, breaking said second resistive element, and disconnecting said discharge vessel from said source of electric potential, said substrate not cracking and not disconnecting said discharge vessel during each lamp start-up.

11. A high pressure sodium discharge lamp according to claim 10, wherein said integral thick film resistor comprises three integral substrate layers, said first and second metallic resistive elements being disposed between alternate substrate layers.

12. A high pressure discharge lamp according to claim 11, further comprising disconnecting means for electrically disconnecting said first resistive element for preventing said integral thick film resistor from exceeding a predetermined temperature.

13. A high pressure discharge lamp according to claim 11, wherein said disconnecting means comprises a bimetal switch mounted on said thick film resistor and effective for disconnecting said first resistive element in response to heat from said thick film resistor in the event of unsuccessful ignition of said discharge vessel and in response to heat from said discharge vessel in the event of successful ignition of said discharge vessel.

14. In a high pressure discharge lamp according to claim 13, wherein said second resistive element is effective for preventing flicker of light emitted from said discharge vessel when said lamp is operated on a constant-wattage-type ballast.

* * * * *